United States Patent [19]

Burruel

[11] Patent Number: 4,942,742

[45] Date of Patent: Jul. 24, 1990

[54] ICE MAKING APPARATUS

[76] Inventor: Sergio G. Burruel, 5635 W. Verde La., Phoenix, Ariz. 85031

[21] Appl. No.: 855,140

[22] Filed: Apr. 23, 1986

[51] Int. Cl.[5] ..... F25C 1/22

[52] U.S. Cl. ..... 62/347; 62/352; 62/356; 249/119

[58] Field of Search ..... 62/73, 74, 356, 347, 62/348, 352; 249/119, 120; 29/157 R, 157.3 R, 163.5 R

[56] References Cited

U.S. PATENT DOCUMENTS

| | | | |
|---|---|---|---|
| 1,066,262 | 7/1913 | Dodge | 62/352 |
| 2,100,288 | 11/1937 | Horlacher | 249/120 X |
| 2,542,892 | 2/1951 | Bayston | 62/347 |
| 3,411,463 | 11/1968 | Moseres | 62/356 X |
| 4,344,298 | 8/1982 | Biemiller | 62/347 |
| 4,505,130 | 3/1985 | Hibino et al. | 62/347 |

*Primary Examiner*—William E. Tapolcai
*Attorney, Agent, or Firm*—Richard R. Mybeck

[57] ABSTRACT

An improved ice cube-forming machine and system comprising a plurality of hollow fluid-conducting conduits in which the outer surface thereof is provided with pocket members extending into the conduit for engagement by any fluid being conducted therethrough to selectively freeze and thaw the contents of the pocket members. A discrete water source feeds each ice cube-forming pocket for freezing while refrigerant is passed through the hollow conduits. When the water is frozen within the pockets, a control system reacts thereto to stop the flow of refrigerant and initiate the flow of heated fluid through the hollow conduit to thaw at least the surface of the ice cube and release the ice cube therefrom whence, as by gravity, it drops into a collection receptacle. The pocket members can be either a plurality of integral depressions formed therein or independent members secured thereto. In either event, the fluid selectively directed through the conduits will effect the contents of the pocket member through its thermally conductive body portion to either freeze the water therein or dislodge the ice cubes therefrom.

9 Claims, 3 Drawing Sheets

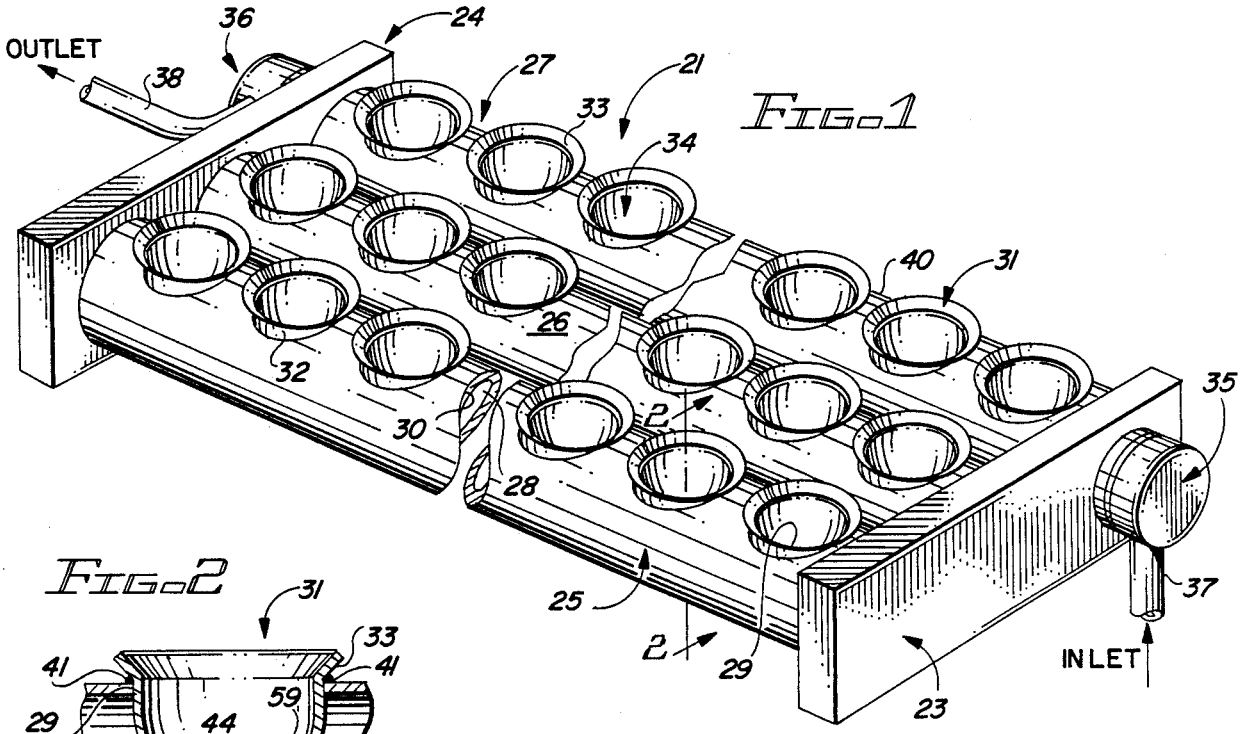
FIG. 1
FIG. 2
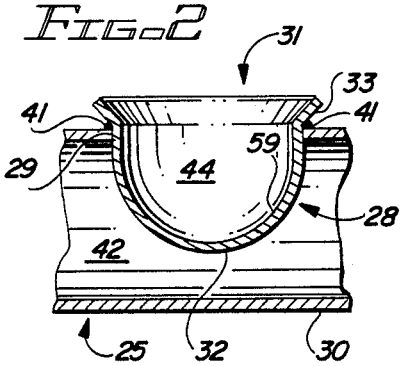
FIG. 3
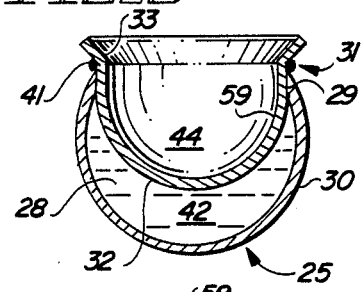
FIG. 5
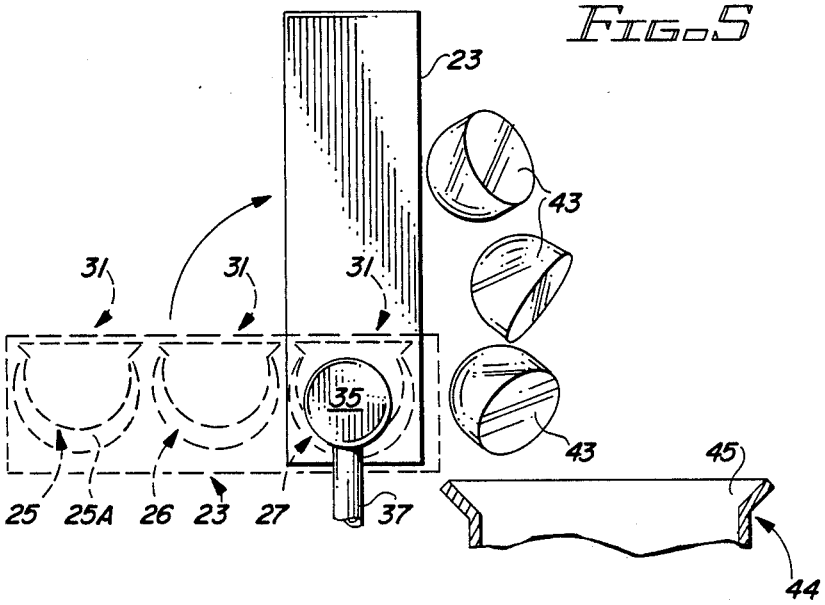
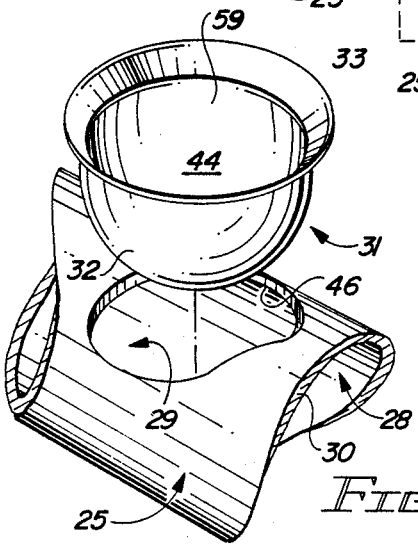
FIG. 4
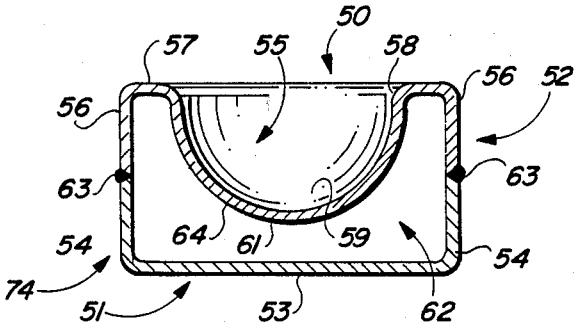
FIG. 7

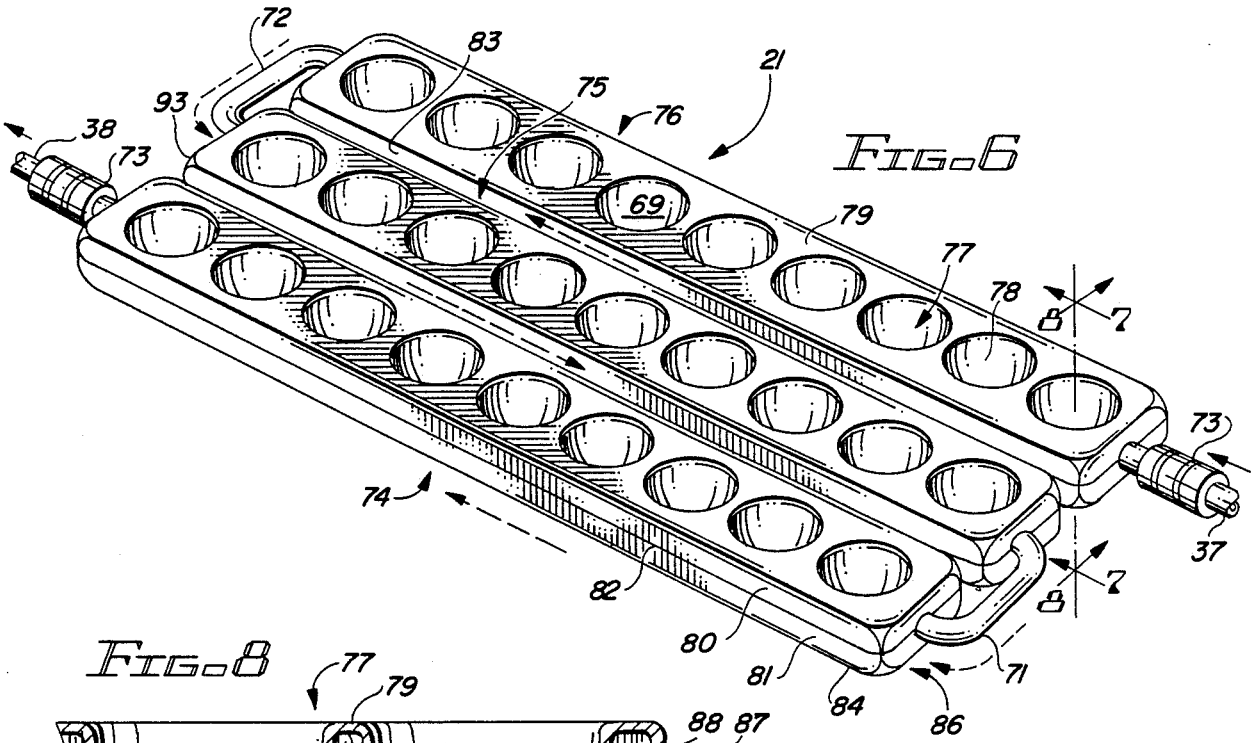
FIG. 6
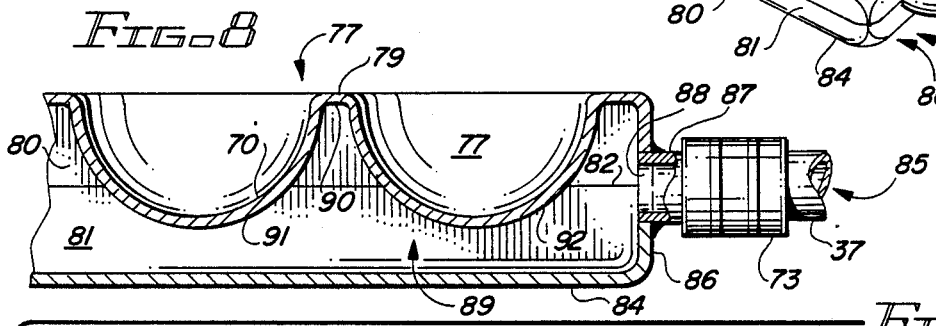
FIG. 8
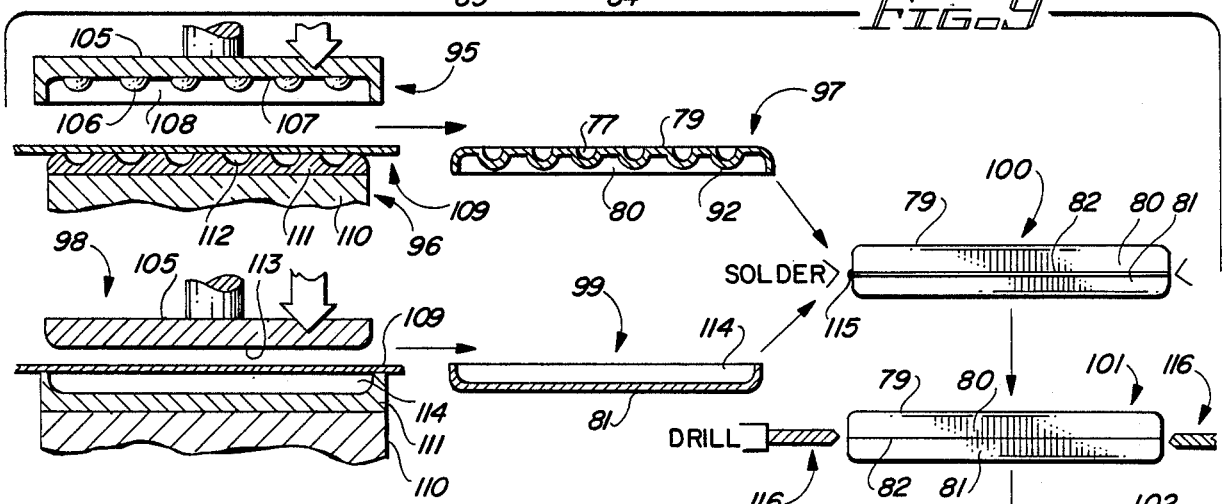
FIG. 9
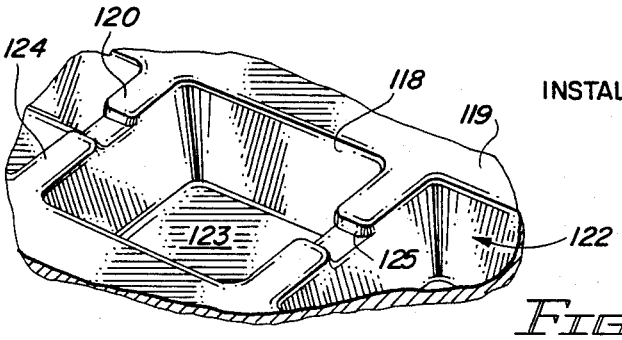
FIG. 10
FIG. 11

FIG. 12
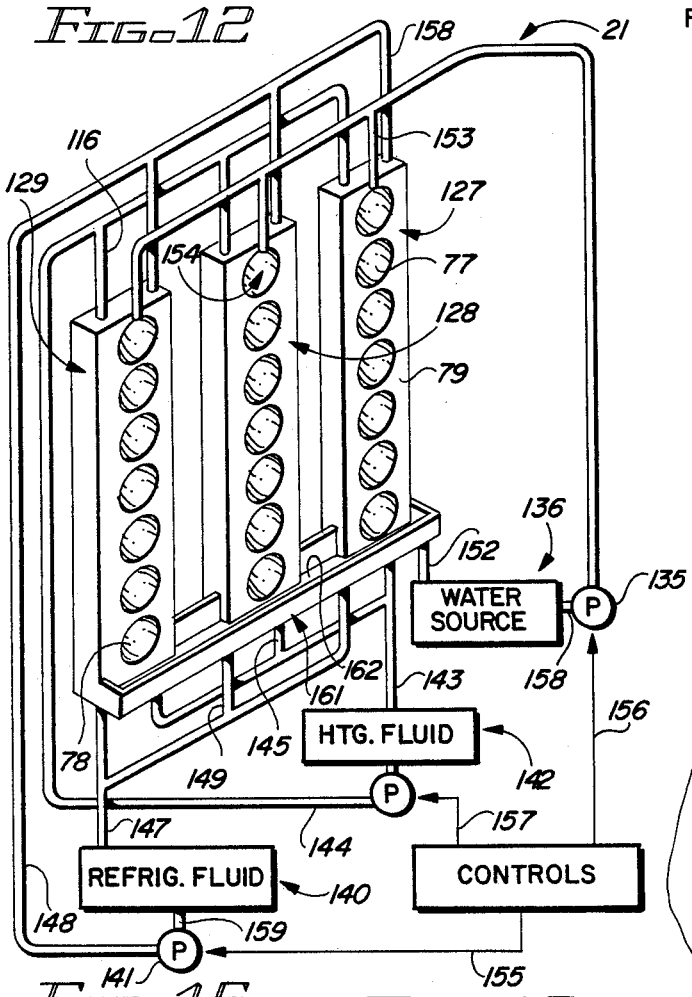
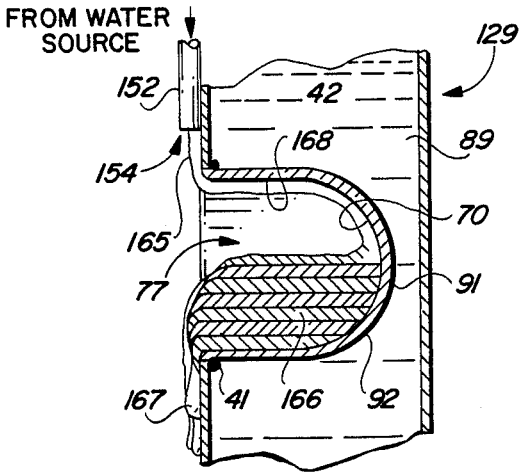
FIG. 13
FIG. 14
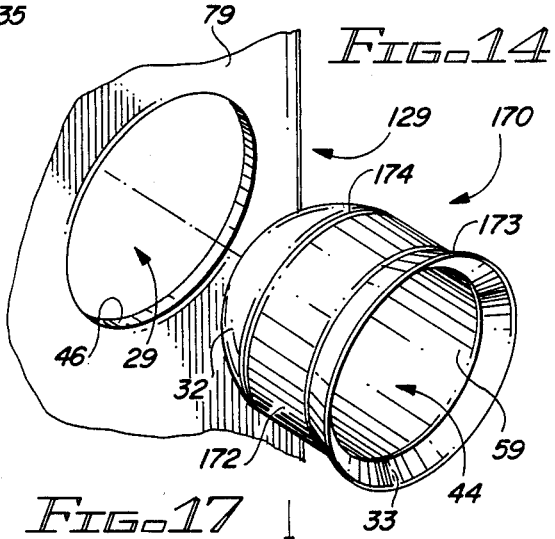
FIG. 15
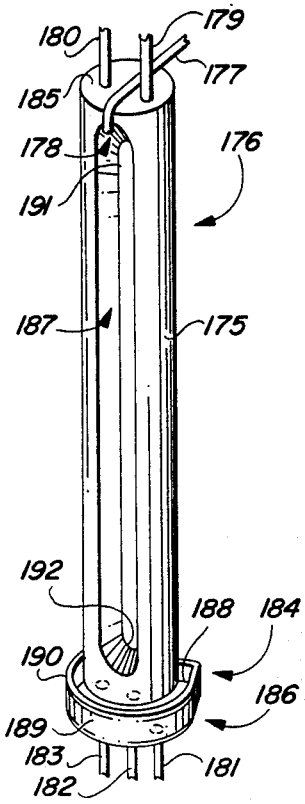
FIG. 16
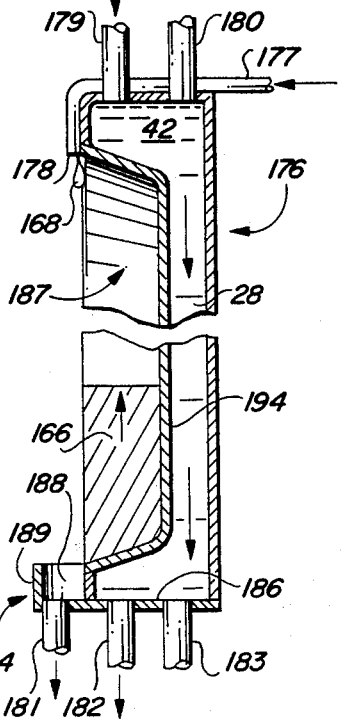
FIG. 17
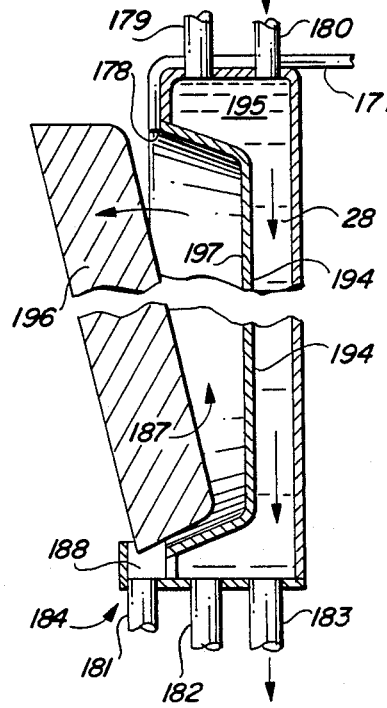

ICE MAKING APPARATUS

BACKGROUND OF THE INVENTION

1. Field of the Invention

The present invention relates generally to an improved ice-making apparatus and more particularly to an apparatus for producing a plurality of ice cubes in a variety of geometrically-shaped ice portions more quickly and more rapidly than heretofore possible in the prior art.

2. Description of the Prior Art

The various ice making systems of the prior art are extremely limited by the fact that the ice-making process (1) consumes a great deal of energy so that it is relatively expensive; (2) is relatively slow due to the time required to freeze the water into ice and the time required to release and empty the frozen ice cubes into a collection receptacle; and (3) the overall efficiency of the prior art systems is relatively low from any conventional standpoint.

For example U.S. Pat. No. 2,918,803 issued on Dec. 29, 1959 for an Automatic Ice Maker. This patent shows an ice-making apparatus which includes a tray which may be made from metal having a relatively high heat conductivity and which may be located in a heat exchange relationship with respect to an evaporating freezer chamber. The tray has a plurality of cavities therein which open to the tray which are shown as being formed in the general shape of a hemisphere. The cavities are shown as having flexible molds sealing the open ends thereof for normally conforming to the shapes of the cavities and enabling the frozen ice cubes to be ejected from the molds by inverting the tray.

Similarly, U.S. Pat. No. 2,729,070 issued in 1956 for an Ice Cube Machine. This patent discloses an ice cube-making machine wherein the ice cubes are continually build-up by a coating of water applied to a refrigerated surface from a supply tank and wherein the excess water is returned to the supply tank for precooling the water. The receptacles for freezing the individual ice cubes are contained within the same unit housing the water supply, and the water is directed upwardly into the ice cube-containing cups, but no portion of the cup is in direct heat exchange relationship with any type of refrigerant means.

U.S. Pat. No. 2,559,414 shows a system wherein an ice cube is formed in a freezing receptacle and automatically released by the heat produced from hot compressed gas; and U.S. Pat. No. 2,941,379 shows an ice-making apparatus in which a thermal motor-operated device can be energized and deenergized at appropriate intervals to repetitively remove ice components from an ice mold and refill the mold following the completion of each freezing operation.

U.S. Pat. No. 2,259,066 was granted in 1941 on a Refrigerating Machine and this patent discloses cylindrical molds positioned within a block. Refrigerant moves through the coils in the block for freezing the water in the molds to make ice. Again, no direct contact is provided between the circulating refrigerant and the molds themselves.

U.S. Pat. No. 2,250,971 issued in 1941 for Refrigeration and shows a refrigerating system having an evaporator in heat exchange relationship with a body of water at a plurality of points and means to divert the liquid refrigerant selectively from a condenser to different points in the evaporator in order to freeze ice in different portions of a water tank.

U.S. Pat. No. 4,344,298 issued in 1982 for an Ice Cube-Forming Tray for an Ice-Making Machine; and the patent discloses an ice cube-forming tray which includes a plurality of side-by-side corrugated plates having alternate ridges and grooves wherein straight plates separate the corrugated plates from those which are not corrugated. Those not corrugated, instead of being straight, may be hollow, diamond-shaped devices for carrying the refrigerant through the apparatus for freezing the water in the compartments.

While the prior art discloses many features used in conventional ice-making systems to date. None of such systems teach a method and apparatus which solves substantially all of the problems of the prior art while avoiding the problems and inefficiencies thereof by producing a plurality of ice cube-forming pockets, cavities, or receptacles which are disposed on at least one surface of the conduit actually conducting both the refrigerant and the heating material therethrough so that the ice cubes are formed and released faster, since at least the bottom surface of the actual ice cube mold or receptacle extends into the hollow interior of the conduit and directly contacts the fluid being conducted therethrough.

SUMMARY OF THE INVENTION

It is an object of the present invention to provide an improved ice cube-forming apparatus with a far shorter freezing and releasing cycle time than heretofore possible in the prior art.

It is another object of the present invention to provide an ice cube-forming apparatus which quickly and easily forms and releases ice cubes into a receptacle in a highly efficient and energy-conserving manner.

It is still another object of the present invention to provide at least one elongated conduit having a hollow interior, a conduit surface, and at least one ice-forming pocket formed in the surface for collecting water for making the frozen ice portion while the surface of the pocket opposite from that forming the ice cube extends into and within the hollow fluid-conducting interior of the conduit for directly contacting both the refrigerant and the heating medium contained therein for more quickly forming the ice cubes and for more quickly releasing the ice cubes.

It is a further object of the present invention to provide an improved ice-making apparatus including a plurality of conduits each including at least one but preferably a plurality of ice cube-forming cavities operably disposed on at least one surface thereof and possibly on opposite surfaces of the conduit such that each of the cavities forms an external ice cube-forming recess and an internal surface operably disposed within the hollow interior of the conduit for directly contacting the fluid flowing therethrough.

It is still a further object of the present invention to provide an improved ice-making apparatus wherein one or more elongated conduits have one surface provided with a plurality of apertures, and a plurality of individual cup-shaped members are inserted within each of the apertures such that the bottom portions of the cup-shaped members directly contacts the fluid being circulated through the hollow interior of the conduit for , more quickly forming the ice cube portions within the cavities or cells and for more quickly releasing the formed ice portions therefrom.

It is still another object of the present invention to provide an ice-making system which includes one or more conduits having one or more indentations, depressions, or recesses pressed into at least one surface thereof for forming a plurality of pockets, cells, mold cavities, or recesses for collecting water and freezing same to form the ice cubes while the bottoms of the indentations protrude a substantial distance into the hollow interior of the conduits.

It is yet a further object of the present invention to provide a plurality of conduits provided with ice-making pockets or cells on at least one surface thereof wherein the pockets are vertically oriented such that the flow of water downward across the surface thereof causes the water to collect in the formed cavities for producing the frozen ice portions and enables the released ice cubes so that they can be emptied gravitationally into a collection receptacle.

It is yet another object of the present invention to provide an improved method of manufacturing the apparatus of the present invention.

It is yet a further object of the present invention to provide various alternative embodiments to both the cup and aperture version and the indentation version of the ice-making apparatus of this invention.

It is still a further object of the present invention to provide one or more elongated conduits having one or more elongated troughs, mold cavities, or pocket portions formed therein for forming elongated ice portions for later processing into crushed ice or the like.

The present invention shows an ice-making system for producing ice in any given one of a variety of geometric shapes and sizes, all of which are referred to herein as ice cubes. It will be recognized that use of the word cubes is not used in a geometric sense, but simply to describe any shape of ice portion produced by the present system. The system includes a supply of fluid refrigerant for turning water into ice and means for circulating the fluid refrigerant through the system. It also includes a source of heating fluid, a means for heating the fluid, and means for circulating the heated fluid through the system. Further, the system includes a water supply, means for conducting the water to form ice cubes, means for collecting the return water for recirculation and means for purging the water system when required. Lastly, the system must include a receptacle for collecting the ice portions after they are formed, released and emptied for later use.

The improved ice cube-producing apparatus of the present invention includes at least one and preferably a plurality of substantially hollow fluid-conducting conduit means each having first end portion and an opposite end portion. The conduit means include a first fluid inlet means operatively coupled at one of the first and opposite end portions for introducing the circulated refrigerant thereto, and a first outlet means operatively coupled at the other of the first and opposite ends for returning the circulated refrigerant for return to a supply. Similarly, a second fluid inlet means is provided at one of the first and opposite end portions of the conduit for introducing the circulated heating fluid, and a second outlet means is provided at the other of the first and opposite end portions for returning the heating fluid, now spent, to a supply source. The conduit includes at least one surface portion generally extending substantially the entire longitudinal length thereof between the inlet means and the outlet means.

At least one ice-forming pocket or mold cavity and preferably a plurality of same are operably disposed along the surface portion of the conduit and preferably aligned with one another along the longitudinal axis thereof for producing the ice cubes. The pockets or cells are such that the opening or mouth of the cavity is disposed on or above the surface of the conduit for collecting water and freezing same to form the ice cubes, whereas the external surface extends physically into the hollow interior of the conduit for direct contact with the refrigerant fluid or heating fluid then being circulated therethrough.

Means are provided for supplying and directing the flow of water substantially across the surface including the pockets and collecting same in the individual pockets or cavities. The contact of the lower surface portion of the cavity-forming member operably disposed within the hollow interior of the conduit directly contacts the refrigerant being circulated therethrough to more quickly freeze the water collected in the cavities so as to more quickly form the ice cube of the present invention. Similarly, the control means is operative, on either a timing cycle, by feedback sensors, or the like to replace the flow of refrigerant with the flow of a heated fluid which is circulated through the hollow interior of the conduit for directly contacting the portion of the cavity mold extending therein to more quickly melt at least the surface portion or layer of the ice cube directly contacting the interior surface of the cavity for releasing the ice cube and enabling it to be emptied into the collection receptacle so that the next ice cube-producing cycle can begin more quickly than heretofore possible.

Means are provided for collecting the return water and utilizing the water which is now colder than it was previously due to its passage across the surface of the conduit means to return to the water supply for precooling same. The control means is operative to pump a selected one of either the fluid refrigerant or the heating fluid through the system for cyclically forming, releasing, and emptying the ice cubes into a collection receptacle for later use or the like.

Various apparatus embodiments and methods for manufacturing the apparatus of the present invention, for making ice cubes in accordance with the method and apparatus of the present invention and in the ice cube-making apparatus itself are also provided. The main feature in each is the formation of the cavity molds, cells or pockets on at least one of the surfaces of the conduit so that at least a portion of the actual cavity-forming means or pocket-forming means extends at least a predetermined distance into the hollow interior of the fluid-conducting conduit means for directly contacting either the refrigerant or the heated fluid flowing therein for enabling the ice cubes to be frozen and emptied more quickly than heretofore possible with far less energy expended than that which was previously required to produce a given quantity of ice cubes.

In one embodiment, the surface of the conduit means is provided with a plurality of apertures and the cavity-forming molds, cells, or pocket portions are individually-formed and inserted within the apertures so that at least a portion thereof extends into the hollow interior of the conduit, whereas a second major embodiment teaches forming integral indentations or pockets within the surface of the conduit itself so that the depressed bottom surfaces of the indentations or depressions extend at least a predetermined distance into the hollow interior for direct contact with the fluid being circulated therein.

These and other objects and advantages of the present invention will be more fully understood after reading the description of the preferred embodiments, the claims, and the drawings which are briefly described herebelow.

BRIEF DESCRIPTION OF THE DRAWINGS

FIG. 1 is a perspective view of one embodiment of the ice-making apparatus of the present invention;

FIG. 2 is a partial side view showing a separate cavity mold or cup-shaped cell inserted within an aperture of the conduit of FIG. 1;

FIG. 3 is a sectional end view of the apparatus of FIG. 2;

FIG. 4 is a partial exploded view of the mold cavity, conduit and aperture of the apparatus of FIGS. 2 and 3;

FIG. 5 is an end view of the apparatus of FIG. 1 showing the positions of the conduits for both freezing and emptying the frozen ice cubes into a receptacle;

FIG. 6 is a perspective view of yet another embodiment of the ice-making apparatus of the present invention;

FIG. 7 is a sectional end view of one of the conduits and integral mold cavities of the apparatus of FIG. 6;

FIG. 8 is a sectional side view of one of the conduits and integral mold cavities of FIG. 6;

FIG. 9 is a collective schematic representation of a method of manufacturing yet another embodiment of the ice-making apparatus of the present invention;

FIG. 10 is a partial perspective illustration of still another embodiment of the mold cavity with improved means for conducting water from one cavity to the next;

FIG. 11 is a top plan view of still a further alternate embodiment of the ice-making apparatus of the present invention such as that which could be manufactured by the method of FIG. 9;

FIG. 12 is a perspective view of still another ice-making system of the present invention;

FIG. 13 is a partial sectional side view of one of the mold cavities or cells of the vertically-oriented system of FIG. 12;

FIG. 14 shows the aperture and cup-shaped member construction which can be alternatively used with the system of FIG. 12;

FIG. 15 shows a perspective view of another embodiment of an ice-making apparatus of the present invention;

FIG. 16 shows a sectional side view of the apparatus of FIG. 15; and

FIG. 17 shows the apparatus of FIG. 16 with the ice cube being emptied therefrom.

DETAILED DESCRIPTION OF THE PREFERRED EMBODIMENTS

FIG. 1 shows one embodiment of the ice-making apparatus or assembly 21 of the present invention. The assembly 21 includes at least first, second and third, generally hollow, cylindrical tubes or conduits 25, 26 and 27, respectively. Each of the conduits 25, 26 and 27 includes a substantially hollow interior, an inlet end and an outlet end. Each of the inlets of the conduits 25, 26 and 27 are operatively connected to outlets (not seen) from a first common, generally rectangular, hollow end manifold 23, while the outlet ends of the conduits 25, 26 and 27 are correspondingly connected to the inlets of a second common generally rectangular, hollow manifold assembly 24 at the opposite end of the conduits. An inlet 37 supplies a selected one of a refrigerating fluid and a heating fluid to a single common input of the input manifold 23 such that the fluid introduced into the manifold 23 is conducted or circulated through the hollow interior 28 of the conduits 25, 26 and 27, and outputted from the opposite ends thereof into the second manifold 24 which commonly couples the conduit outlets and feeds the return fluid circulated through the hollow interior of the conduits to the single common outlet 38 for return to a fluid supply, source, or reservoir, as hereinafter described.

In the embodiment of FIG. 1, each of the end manifolds 23 and 24 are provided with fluid tight swivel joints 35 and 36, respectively, for operatively coupling the inlet 37 and outlet 38 to the manifolds 23 and 24, respectively, in such a manner that the entire assembly, including the manifolds 23 and 24 and the conduits 25, 26 and 27 coupled therebetween can be rotated from a first, generally horizontal position in which the ice cubes are formed to a second, generally vertical, tilted, or partially inverted position wherein the formed ice cubes can be released and emptied from the mold cavities into a collection receptacle, or the like.

Each of the elongated tubes or conduits 25, 26 and 27 of FIG. 1 have a longitudinal axis therethrough and they normally are oriented in a side-by-side manner with each of the longitudinal axes lying parallel to one another. Each of the conduits 25, 26 and 27 is provided with at least one surface portion extending substantially along the entire length thereof between one end and the other or between inlet and output manifolds 23 and 24. The surface may be, as illustrated in FIG. 1, provided with a plurality of apertures communicating the exteriors of the conduits 25, 26 and 27 with the hollow interiors thereof. A plurality of separate and distinct individual cavity molds, cup-shaped members, cells, pockets or cube-forming members 31 are provided and each includes a bottom portion 32 which is generally rounded in FIG. 1 and an outwardly-directed outer annular flange or rim portion 33 which both prevents the cup-like portions 31 from extending more than a predetermined distance into the hollow interior 28 of the conduits 25, 26 and 27, and which limits the fill level of the hollow ice-forming cavities or pocket interiors 34 while simultaneously providing a fluid tight seal to each of the apertures 29. The apertures 29 are formed on the at least one surface (and possibly on opposite surfaces) of each of the conduits 25, 26 and 27 by cutting or drilling through the wall portions 30 into the hollow interior 28 to provide generally circular apertures for insertion of the circularly-rounded bottom portions 32 of the cup-like members 31. The surface of the longitudinal conduits 25, 26 and 27 on which the apertures 29 are formed is illustrated by the reference numeral 40.

FIGS. 2, 3 and 4 better illustrate the detailed relationship between the mold-forming receptacles or cup-like members 31 of the apertures 29 and the conduit interior 28 of FIG. 1. The tube or conduit 25 is shown as having an outer cylindrical tube wall 30 for forming a hollow interior 28 therethrough. An aperture 29 is formed through the wall portion 30 of one surface 40 thereof and a cup-shaped member 31 is inserted therein. The cup-shaped member 31 includes a generally rounded bottom portion 32 and an outer or upper, generally outwardly-directed annular flange or rim portion 33 which generally limits the distance which the cup-shaped member 31 can have its bottom portion 32 inserted within the hollow interior 28 through the hole or aperture 29 defined by the aperture-defining walls forming the mouth of aperture 29 of the conduit 25. A watertight seal is provided about the upper end of the rounded bottom portion 32 of the receptacle 31 or about the lower portion of the annular flange 33 as by solder bead 41 to provide both a fluid tight seam or seal about the lip of the aperture 29 for preventing the escape of the fluid within the hollow interior 28 of the conduit 25 through the aperture 29 and for fixedly and mechanically securing the pocket member or mold cell 31 to the conduit 25.

The hollow interior 28 is used for conducting a selected one of either a fluid refrigerant material or a heating fluid or heat exchange means, as conventionally known in the art. The fluid is represented by the reference numeral 42 and it will be observed that the fluid 42 directly, physically contacts the rounded lower portion 32 of the mold cavity-forming unit 31 over substantially all of its outer or exterior surface which protrudes or extends within the hollow interior 28 of the conduit 25 so that it is in direct contact with any fluid being conducted or circulated therethrough. Lastly, the interior surface or cavity-defining surface 59 of the cup-shaped member or mold cell 31 is shown as including a relatively smooth, rounded, interior surface 59 forming a central cavity 44 for collecting the water and for forming the water as it is turned into ice within the hollow pocket, cell, or cavity 44, as hereinafter described.

FIG. 5 shows the apparatus of the embodiment of FIG. 1 as having the ability to be initially disposed in a horizontal position while the water is being frozen within the mold cavities 31 and then rotated about the swivel joints 35, 36 to a substantial vertical, tilted, partially inverted or totally inverted position for emptying the ice cubes 43 released from the mold cavity 44 of the cup-shaped receptacles 31 and allowing them to fall gravitationally into a collection receptacle 44 as through an opening 45 thereof.

FIG. 6 illustrates another alternate embodiment of the ice-making apparatus 21 of the present invention, and it includes a plurality of generally rectangular, elongated conduits 74, 75 and 76. Each of the elongated conduits 74, 75 and 76 are formed from an upper section 80 and a lower section 81 which are joined along their center line as at joint or seal 82. Each of the generally rectangular elongated conduits 74, 75 and 76 includes an elongated surface 79 which is generally flat and a plurality of indentations, pockets, depressions, or mold cavities 77 which are integrally-formed in the surface 79 such that the bottom portions extends at least a predetermined distance into the hollow interior of the conduits 74, 75 and 76 for directly contacting any fluid circulating therethrough, while the upper openings of each of the cavities 77 are flush with the surface 79.

Each of the conduits include a lower surface 84, an upper surface or top surface 79, and a first end portion 86, an opposite end portion 93. Each of the integrally formed cavities or pockets 77 includes a relatively smooth rounded interior surface 78 for forming a hollow cavity portion 69 therein. The first end portion 86 of conduit 76 is shown as including a fluid inlet 37 coupled thereto by connector 73 (which could be a swivel means) for supplying one of either the refrigerant fluid or heating fluid into the inlet of the end 86 of the conduit 76 for circulation or conduction therethrough. The fluid flows through the hollow interior and exits the outlet 38 at the opposite end 93 where it is coupled through connector tube 72 from the outlet of the conduit 76 to an inlet at the end 93 of the conduit 75. It is then conducted through the hollow interior of the conduit 75 and passes through the outlet at the opposite end 86 where it is interconnected by a conduit 71 which supplies fluid to the input of conduit 84 to pass the fluid through the hollow interior thereof and return it to the output tube 38 via connector 73 (which may also be a swivel means). This type of serpentine path as illustrated in FIG. 6 can be used although the refrigerant warms or takes on heat and the heater fluid cools or loses heat more quickly when such a long series-type path is used. The parallel paths illustrated in other embodiments of the present invention such as those which employ common manifolds, and the like are more practical since the refrigerant takes on less heat and the heating fluid loses less of its heat through a given predetermined length of conduit by parallel conduction.

FIG. 7 illustrates a cross-section of a conduit-integral pocket assembly 50 as used in the apparatus of FIG. 6. The assembly 50 represents a cross-section of a generally rectangular elongated conduit 74 including a lower conduit portion 51 and an upper conduit portion 52. The lower conduit portion 51 includes a generally open, box-shaped configuration having a pair of sides 54 and a relatively flat bottom 53. The top 52 includes a pair of relatively straight downwardly distending sides 56, a relatively flat top surface 57 and a cup-shaped mold cavity or pocket 55 integrally formed in the top surface 57 by depressing or indenting the bottom 61 downwardly into the interior 62 of conduit 74. The interior surface 59 of the mold cavity 55 is relatively smooth and rounded for ease of ejecting the ice cubes formed therein while the bottom external surface 64 of the bottom 61 extends into the hollow cavity 62 formed when the upper portion 52 is connected to the lower portion 51 as by soldering 63 to produce a single unitary conduit 74. It will be noted that the bottom 61 of the mold cavity 55 has its exterior surface 64 extended downwardly into the conduit cavity 62 so as to be directly exposed in direct physical contact with the fluid flowing within or being circulated through the hollow interior 62. The direct exposure of the bottom surface walls 61 of the mold cavity 55 to the fluid flowing within the cavity 62 results in the water deposited in the mold cavity 55 being frozen much more quickly and efficiently than otherwise possible and in the frozen cube being released more quickly when the heating fluid is conducted through the cavity 62, so that the entire repetitive cycle of freezing, releasing, and emptying the ice cubes 43 from the cavities 55 is greatly shortened with far more cubes produced in a given amount of time or with a given amount of energy.

FIG. 8 shows a partial side view of the conduit 76 of FIG. 6. It will be seen that the bottom surface 84 is relatively flat, as is the top surface 79. The upper half 80 and lower half 81 are shown as being fixedly secured to one another in a fluid-tight manner along the seam 82 as by soldering or the like. The inlet 37 shows a passage 85 through which the refrigerant fluid or heating fluid passes for circulation through the hollow interior 89 of the conduit 76. The inlet tube 37 is coupled to a rotatable coupling 73 and the tube portion 87 extending therefrom is connected directly to the inlet aperture 88 at the end portion 86 of the conduit 76. Therefore, the fluid currently selected by the control means will be pumped from the source through the inlet tube 37 and through the opening 88 into the hollow interior 89 of the conduit 76. It is then circulated or conducted through the hollow interior 89 of the conduit 76 until it passes through the outlet tube 38 from whence it is returned to the supply for recirculation. The top surface 79 of the conduit 76 is shown as including integral cup-shaped cavities, mold cavities or pockets 77 having a relatively smooth internal cavity interior surface 70 for defining the ice cube or ice portion-forming cavity 77. The portions of the top surface 79 not depressed to form the depressions 69 are designated by reference numeral 90. The bottom portion 91 of the cavity molds 77 each includes an outer exterior fluid contacting surface 92.

Since some applications may require that two layers of material be present to separate the water and ice from the refrigerant and/or heating fluid, the layer 211 of FIG. 8 represents such a layer. The layer 211 may be formed only on the inside surface 70 of the walls 91 of the cells 77 within each cavity itself or it could be used over the surface 79 as well. The second layer 211 could be a second layer of copper or a suitable heat-conductive metal. It could also be a thin plastic layer of some conventional food grade material. It could be formed mechanically, coated, sprayed, dipped, anodized, plated, electrically deposited, or the like, as conventionally known in the art.

FIG. 9 represents a method of manufacturing yet another embodiment of the ice cube-making or producing apparatus of still another embodiment of the present invention. Step 95 illustrates providing a top stamp, while step 96 represents providing a lower or bottom stamp. Step 97 represents the top of the conduit formed in the stamping operation. Step 98 represents a second top and bottom stamp for producing the bottom portion of the conduit in step 99. Step 100 represents combining or connecting the top and bottom portions of the conduit, while step 101 represents drilling the corresponding inlet apertures and outlet apertures in the appropriate end portions of the assembled conduit. Finally, step 102 represents connecting the inlet and outlet tubes to the drilled openings.

The top stamp of step 95 includes a base portion 105 having a downward facing cavity 108 whose top surface is provided with a plurality of cup-forming members 106 extending from the top planar surface 107 thereof. The bottom of step 96 includes a base support 110 for supporting a solid portion 111 provided with a plurality of cup-shaped indentations or depressions 112 adapted to matingly receive the protrusions 106 of the top stamp therein. A sheet of material, preferably a metal having a relatively high heat conductivity, such as copper or the like, which is represented by the sheet 109, is then placed over the surface of the lower stamp, and the top and bottom stamp portions are closed upon one another to press the indentations into the top sheet 109 via the protrusions 106 forcing selected portions of the sheet into the cavities 112 of the lower mold, while the side and end portions are pushed downwardly to form the sides surrounding the interior of the upper portion 80 of the conduit 76.

Step 97 illustrates the top portion 80 of the conduit 76 which is produced by the first stamping operation, and it will be seen that a plurality of cup-shaped indentations or mold cavities 77 are formed in the top surface 79 of the upper half 80 of the conduit 76 with the bottom portion 92 of each of the mold cavities being operatively disposed at least a predetermined distance downwardly from the plane of the upper surface 79 and within the hollow cavity to be formed in the conduit 76.

Step 98 illustrates the use of a cavity-forming stamp 105 having a lower stamping surface 113. The bottom portion of the stamp includes a base 110 having a cavity-forming cooperating die 111 for forming a cavity 114. A sheet of identical metal 109 is disposed on top of the base or bottom of the stamp, and the stamp is closed such that the upper portion 105 has its downwardly disposed stamping face 113 depressing the metal sheet 109 within the mold cavity or die cavity 114 for forming the bottom portion 81 of the conduit 76 having the interior 114 as shown in step 99.

Step 100 shows the upper portion 80 and the lower portion 81 combined with one another at the seam 82 which is soldered as indicated by reference numeral 15 to form an enclosed interior within the box-shaped conduit. The ends of the enclosure are then drilled, as represented by reference numeral 116, in step 102, and step 102 shows the inlet tube 37 and outlet tube 38 placed in the drilled apertures to form a finished conduit having a hollow interior through which a fluid may be circulated from the inlet tube 37 to the outlet tube 38 so as to directly contact the bottom exterior surfaces 92 of the mold cavities 77 for more quickly freezing the water contained therein for forming the ice cubes of the present invention and for more quickly heating to melt the outer peripheral ice cube surface abutting the interior of the ice cube abutting or frozen to the interior surface 70 of the cup-shaped mold cavity 77 for releasing the ice cube for emptying into a collection receptacle or the like.

FIG. 10 shows an alternate embodiment of the mold cavities 77 of FIG. 6 and illustrates a generally rectangular cell or a pocket having an inverse truncated, rectangular, pyramid-shaped cavity 122 having a lower or bottom, substantially flat surface 123 and outwardly tapering, cavity-defining sides 118. The upper relatively flat surface 119 is shown as having a plurality of oppositely-facing surface portions 120 and 124 being operably disposed between adjacent cavities 122 and provided with an indentation, canal or fluid-conducting path 121 formed between opposite ends 125 of the surface portions 120 and 124 and recessed a predetermined distance below the planar surface 119 thereof for providing a pathway from one adjacent receptacle 122 to the next for facilitating the passage of water from one cavity 122 to the next through the channel 121 and for preventing the various cavities 122 from over filling.

FIG. 11 illustrates still another embodiment of the present invention which could, for example, be formed in accordance with the method of FIG. 9 wherein an ice-forming, fluid-conducting conduit 200 is formed having a hollow common interior and a plurality of rows each having a plurality of mold cavities 77 distending below the upper planar surface 79 and into the hollow interior of the conduit 200 so that the fluid supplied to the inlet 37 passes commonly through the hollow interior of conduit 200 and exits the outlet 38 for return to the supply and simultaneously form multiple rows of ice cubes, if desired. It will also be recognized that the hollow interior of the multiple row conduit 200 could include separators between adjacent rows of cup-shaped indentations 77 for directing the fluid from the inlet 37 through individual parallel channels beneath each of the rows of cells on the top surface 79 thereof.

FIG. 12 illustrates still another ice-making system embodiment of the present invention. The system of FIG. 12 shows first, second and third, generally rectangular, elongated conduits 127, 128 and 129. Both ends of each conduit 127, 128 and 129 are provided with a pair of apertures so that one end can be provided with inlets for both the refrigerant fluid and the heating fluid while the opposite end is provided for outlet apertures for the return of the refrigerant fluid and heating fluid to their respective sources. Each of the first inlet apertures on one end of the conduits 127, 128 and 129, respectively, are provided with individual inlet tubes 158. The inlet tubes 158 are commonly connected together via the common inlet tube 148 which circulates the refrigerant fluid from the source 140 and supply outlet 159 to the individual inlets 158 of the conduits via common supply tube 148 and the action of the pumping means 141. Similarly, the second inlet aperture of each of the conduits 127, 128 and 129, respectively, is connected to an individual inlet tube 146 and the inlet tubes 146 are commonly connected to a single common supply tube 144 which circulates the heating fluid from the reservoir, source or supply 142 via the pump 163.

Similarly, each of the first apertures at the opposite ends of the conduits 127, 128 and 129, respectively, are connected to individual outlet tubes 149 which are then connected via the common return tube 147 to return the refrigerant to the source or reservoir 140 for further recirculation via the pump 141 and common inlet conduit or tube 148. Similarly, each of the second outlets of the opposite end portions of the conduits 127, 128 and 129, respectively, are connected via individual outlet tubes 145 which are coupled to a common return tube 143 to return the heating fluid to the source or reservoir 142 so it can be reheated and recirculated via pump 163 and the common inlet tube 144.

A water source, reservoir or supply 136 supplies fresh water from its supply outlet 158 which is then circulated via pump 135 through a common water supply conduit or tube 151 to a plurality of individual flow-directing tubes 153 coupled between the common tube 151 and having one of the flow-directing tube portions 153 associated with each of the conduits 127, 128 and 129. Each of the tubes 153 includes an opening at a downwardly disposed end and the outlet 154 of the tubes 153 positioned to direct a flow of water therefrom, and each of the fluid outlets 154 of the flow-directing tubes 153 are disposed longitudinally along the longitudinal axis of each of the elongated conduits 127, 128 and 129, respectively, so that the flow of water out of the outlets 154 of the flow-directing tubes 153 is spread or directed over the surfaces 79 of the conduits directly in line with the corresponding row of cavities 77. Since the entire assembly, including the generally rectangular conduits 127, 128 and 129, are fixedly positioned or oriented in a substantially vertical plane with their individual longitudinal axis parallel to one another and generally perpendicular to ground so that the water flows from the individual outlets 154 down across the surface 79 and into each successive cavity 77 for freezing from the interior cavity surface 78 outward, as hereinafter described.

When the water reaches the opposite end portion or lower end portion of the conduits 127, 128 and 129, it collects in the interior 162 of the return tray or trough 161, and the bottom of the trough 161 is provided with at least one aperture for communicating with the returned water collected in the interior 162 through a tube 152 for returning the water to the source 136 for recirculation. Further, a purge outlet would enable the water supply to be flushed as required. In the preferred embodiment, control means as system 137 is shown as controlling the pump 135 via control path 156, the pump 163 via control path 157, and the pump 141 via control path 155. The control means 137 function such that the refrigerant from the source 140 is first circulated through the inlet tube 148 to the individual inlet tubes 150 and into the first end portion of each of the conduits 127, 128 and 129, respectively, for passage through the hollow interiors of each prior to being returned to the refrigerant source 140 via the return tubes 149 and 147. After a predetermined period of time has elapsed, or in response to a given means for detecting when the ice cubes or ice portions are fully frozen, control means will operate to turn off the pump 159 thereby terminating the flow of the refrigerant through the hollow interior of the conduits 127, 128 and 129 and begin pumping the heated fluid from the reservoir 142 to the inlets 146 via the common supply path 144 and the action of pump 163.

As this heated fluid passes through the hollow interior of the conduit, it directly contacts the outer surface of the receptacle-defining cup-shaped indentations and causes the frozen ice cube within the cavity 77 on the opposite side of the contacted surface to melt a small peripheral layer or surface portion of the ice cube contained therein so as to release the frozen ice cube from the mold cavity 77 and enable it to fall downward from the cavity 77 into a collection receptacle under the force of gravity alone. It will also be understood that since the refrigerant circulating through the hollow interiors of the conduits 127, 128 and 129 also contacts the bottom surfaces of the cavities 77 directly, the heat transfer characteristics insure that the ice cubes formed in the cavities 77 are formed much more quickly than in the prior art systems such that more cycles of forming ice cubes and emptying them from the receptacles 77 can take place for any given amount of energy or any given period of time.

FIG. 13 illustrates the formation of the ice cubes within the hollow mold cavity 77 of the conduit 129 of FIG. 12. The refrigerant 42 is shown as being circulated through the hollow interior of the conduit 129 so as to come in direct contact with the outer surface 91 of the cup-shaped receptacle or cavity mold 92. The hollow interior 77 defined by the interior surface 70 of the mold cavity or receptacle 92 receives a laminar type flow of water from the outlet 154 of the inlet tube 153 with the flow directed longitudinally across the planar surface 79 and into the top of the opening to the cavity 77. The flow of water 168 passes into the cavity 77 from the surface 79, passes along the top portion of the interior wall 70 of the cavity 77 and collects in frozen layers 166 along the opposite side of the mold cavity 92. While water continues to pass over the frozen layers 166, as indicated by the water flow 167, to pass to each successive mold cavity 77 of the conduit 129, the layers 166 will continue to build up within the cavity 77 until a fully formed ice cube or ice portion is produced by the water freezing in the layers 166 until the cavity 77 is full. This occurs in stages simultaneously from top to bottom on the surface 79 of the conduit 129 such that while the lowest receptacle may form its ice cube last, they will actually be formed substantially simultaneously due to the freezing of the water in the layers 166 so that all of the receptacles 177 will be ready to have the ice cubes released and emptied by the force of gravity when the heated fluid is substituted for the refrigerant 42.

FIG. 14 illustrates an alternate embodiment of the conduit 129 wherein the top surface 79 includes aperture forming sides 46 defining a circular aperture 29 through the surface 79. A generally cup-shaped receptacle or mold cavity 170 is shown as having a generally rounded bottom 32, and a cylindrical mid portion 172, and an upper outwardly extending annular rim or flange 33. The flange 33 surrounds an opening into the hollow cavity 44 defined by the inner walls 59 of the receptacle 170. The lower end portion 174 including the bottom 32 and at least a portion of the cylindrical side portion 172 are inserted within the aperture 29 and sealably secured therein for defining an ice forming receptacle having its bottom portion 174 operably disposed at least a predetermined distance below the surface 79 and into the hollow interior of the conduit 129 for directly physically contacting the fluid flowing through the hollow interior thereof for increasing both the freezing efficiency and thawing efficiency of the system.

FIG. 15 shows still another alternate embodiment of the present invention wherein a generally hollow cylindrical conduit 176 is provided. The conduit 176 includes a cylindrical tube portion 175 having opposite end portions or end caps 185 and 186. The end cap 185 is provided with a pair of apertures, and a first inlet tube 179 is adapted to supply the refrigerant fluid to the inlet 179 while a second inlet into the second aperture of the end cap 185 is connected via tube 180 to the source of heating fluid. Lastly, a dispensing tube 177 connects a source of water to a flow-directing outlet 178. An elongated indentation or trough is formed in the cylindrical surface of the tube 175 as illustrated by the reference numeral 187, and the trough 187 may include a single longitudinal groove longitudinal channel slot or channel having a top portion 191 and a lower portion 192, with the bottom of the trough 187 extending substantially the length of the cylinder 175. The flow-directing outlet 178 directs the water supplied by tube 177 into the trough 187 so that it freezes in layers along the interior thereof with the remaining water passing out of the trough 187 and off of the outer surface of the cylinder 175 to collect in the annular interior 188 of the collection cap 190. The interior 188 is connected to a water return tube 181 for emptying the return collection container portion 190 and returning the water to the source for recirculation to the flow-directing outlet 178 via tube 177. Similarly, the hollow interior of the generally hollow, elongated cylinder 175 includes a pair of apertures through the lower distal end portion 186 and the refrigerant returned to 182 is connected to one of the apertures while the heating fluid conducting tube 183 is connected to the other aperture for returning fluids to their respective sources for recirculation through the hollow interior of the conduit 176.

Lastly, FIGS. 16 and 17 illustrate still another embodiment of the ice-making apparatus of the present invention. A generally rectangular conduit 176 is provided and the conduit 176 has a hollow interior for passing, conducting or circulating a refrigerant fluid 42 from a source tube 79 through the hollow interior of the conduit 176 and out of an outlet return tube 182 at the opposite end 186 of the conduit 176. Similarly, the inlet tube 180 is connected to a second inlet of the upper end of the conduit 176 for alternatively supplying a heating fluid into the hollow cavity 28 of the conduit 176 for circulating same through the hollow interior 28 and out of the aperture at the opposite end 86 communicating with the return conduit or tube 183 for returning the heating fluid to a source. It will be seen that the mold cavity forming receptacle or member 187 includes a generally hollow interior which is adapted to be filled with the water 168 flowing from the outlet 178 disposed at the top of the vertically oriented conduit 176 with the water being supplied via supply tube 177 to the flow directing output 178. As the water contacts the interior surfaces of the cavity 187 it freezes in layers as previously described and forms an ice cube 196 in layers as indicated by the reference numeral 166. The water exiting the hollow interior 187 and the surface of the conduit 176 adjacent the cavity 187 flows downwardly and is caught or collected in the interior 188 of the return water collection tray 189 which supplies the collected water via an outlet through the return tube 181 to the source of water for recirculation.

It will also be seen that the lower distal end 186 is provided with a first aperture communicating with the refrigerant return tube 182 and a second aperture communicating with the heating fluid return tube 183. The collection chamber or portion 184 defined by the sides 189 for forming the collection interior 188 collects the water which does not form into ice, this water has been significantly cooled by its passage across the already-formed ice and the cold surface of the conduit due to the relatively high heat conductivety or portion from which the conduit 176 is constructed. Therefore, the cold water collecting in the collection unit 184 and passing through the common return conduit 181 serves to pre-cool the stored water in the source 136 so that the water becomes colder and colder and hence closer to freezing on each successive cycle of operation. Once the cavity 187 is full of frozen water and has formed the ice cube or portion 196, the heating fluid 195 is substituted for the refrigerant 42 and as it passes through the hollow interior 28 of the conduit 176, it directly contacts the exterior surface 194 of the mold cavity 187 so as to heat the interior surface 197 of the cavity 187 due to the heat conductivity of the metal of which it is constructed and melt at least that portion of the ice cube directly contacting the interior surface 197 so as to release the ice cube 196 from the cavity 187 thereby allowing it to fall or drop into a collection receptacle, not shown, but known in the art, by the force of gravity alone and due to the outwardly directed tapered sides 201 which greatly facilitate passage of the ice cube 196 from the hollow interior 197 once the contacting portions are released.

It will be understood by those of ordinary skill in the art that various modifications, variations, substitutions, and changes in material, shape, orientation and construction can be made without departing from the spirit and scope of the present invention which is limited only by the appended claims.

I claim:

1. The improvement in a device for producing a plurality of discrete ice cubes having operatively associated therewith: means for supplying and circulating a fluid refrigerant therethrough; means for supplying and circulating a heating fluid therethrough; means for supplying water thereto; forming means for holding said water for conversion into discrete ice cubes by the action of the fluid refrigerant thereupon and for releasing said discrete ice cubes therefrom by the action of the heating fluid thereupon; and control means operative to selectively direct either fluid refrigerant or heating fluid into active relationship with said forming means to respectively form ice cubes therein or release said ice cubes therefrom; the improvement comprising: a plurality of interconnected conduits, each of said conduits having an exterior surface and a substantially hollow interior, each said conduit having a first end and a second end, each said first end being operatively connected to the supply of refrigerant fluid and the supply of heating fluid to receive said fluids therefrom, each said second end being operatively connected to a return for receiving said refrigerant fluid and said heating fluid from each said conduit and delivering each of said fluids to its respective supply; each said conduit having at least one pocket member defined in said exterior surface; means for delivering water from said water supply to fill each said pocket member; means for collecting water in excess of that retained in each said pocket member and returning said excess water to said water supply; control means operatively associated with said supply of fluid refrigerant and said supply of heating fluid simultaneously to selectively direct either said fluid refrigerant or said heating fluid into each said conduit for engagement with said pocket member to respectively form ice cubes therein or release ice cubes therefrom; and means to receive and hold ice cubes released from said pocket members, said conduits being interconnected in series.

2. The improvement in a device for producing a plurality of discrete ice cubes having operatively associated therewith: means for supplying and circulating a fluid refrigerant therethrough; means for supplying and circulating a heating fluid therethrough; means for supplying water thereto; forming means for holding said water for conversion into discrete ice cubes by the action of the fluid refrigerant thereupon and for releasing said discrete ice cubes therefrom by the action of the heating fluid thereupon; and control means operative to selectively direct either fluid refrigerant or heating fluid into active relationship with said forming means to respectively form ice cubes therein or release said ice cubes therefrom; the improvement comprising: a plurality of interconnected conduits, each of said conduits having an exterior surface and a substantially hollow interior, each said conduit having a first end and a second end, each said first end being operatively connected to the supply of refrigerant fluid and the supply of heating fluid to receive said fluids therefrom, each said second end being operatively connected to a return for receiving said refrigerant fluid and said heating fluid from each said conduit and delivering each of said fluids to its respective supply; each said conduit having at least one pocket member defined in said exterior surface; means for delivering water from said water supply to fill each said pocket member; means for collecting water in excess of that retained in each said pocket member and returning said excess water to said water supply; control means operatively associated with said supply of fluid refrigerant and said supply of heating fluid simultaneously to selectively direct either said fluid refrigerant or said heating fluid into each said conduit for engagement with said pocket member to respectively form ice cubes therein or release ice cubes therefrom; and means to receive and hold ice cubes released from said pocket members, said conduits being disposed in substantially vertical spaced relationship to each other.

3. The improvement in a device for producing a plurality of discrete ice cubes having operatively associated therewith: means for supplying and circulating a fluid refrigerant therethrough; means for supplying and circulating a heating fluid therethrough; means for supplying water thereto; forming means for holding said water for conversion into discrete ice cubes by the action of the fluid refrigerant thereupon and for releasing said discrete ice cubes therefrom by the action of the heating fluid thereupon; and control means operative to selectively direct either fluid refrigerant or heating fluid into active relationship with said forming means to respectively form ice cubes therein or release said ice cubes therefrom; the improvement comprising: a plurality of interconnected conduits, each of said conduits having an exterior surface and a substantially hollow interior, each said conduit having a first end and a second end, each said first end being operatively connected to the supply of refrigerant fluid and the supply of heating fluid to receive said fluids therefrom, each said second end being operatively connected to a return for receiving said refrigerant fluid and said heating fluid from each said conduit and delivering each of said fluids to its respective supply; each said conduit having at least one pocket member defined in said exterior surface; means for delivering water from said water supply to fill each said pocket member; means for collecting water in excess of that retained in each said pocket member and returning said excess water to said water supply; control means operatively associated with said supply of fluid refrigerant and said supply of heating fluid simultaneously to selectively direct either said fluid refrigerant or said heating fluid into each said conduit for engagement with said pocket member to respectively form ice cubes therein or release ice cubes therefrom; and means to receive and hold ice cubes released from said pocket members at least one of said conduits having a plurality of pocket members disposed axially therealong in spaced relationship to each other, each said annular flange of each said pocket member having a feed channel defined therein to facilitate the flow of water between adjacent pocket members.

4. A system for producing ice cubes comprising: a plurality of generally elongated, substantially hollow fluid conducting conduit means each having a longitudinal axis, at least one longitudinal conduit surface, a first end portion, a second end portion opposite said first end portion, fluid inlet means operatively connected to one of said first end portions and one of said conduit means and one of said second end portions on a different one of said conduit means, fluid outlet means operatively connected to the ends of said conduit means opposite to the ends connected to said fluid inlet means, said conduit means being disposed so that the longitudinal axis thereof are disposed in spaced generally parallel relationship to each other; a supply of fluid refrigerant means; means for circulating said fluid refrigerant means simultaneously to said inlet means of each said conduit means, through the hollow interior thereof, and out of said outlet means thereof for return to said fluid refrigerant supply means; a supply of heated fluid heat exchange means; means for circulating said fluid heat exchange means simultaneously to said inlet means of each said conduit means, through the hollow interior thereof and out of said outlet means thereof for return to said fluid heat exchange means supply; a supply of water; water flow-directing means operatively disposed relative to said conduit means for directing a flow of water along said conduit surface; means for feeding water from said water supply to said flow directing means; a plurality of ice-forming pockets operably disposed in the surface of each of said conduit means to receive said water from said water flow directing means therewithin; control means for selectively and simultaneously circulating said fluid refrigerant means through each of said conduit means for freezing the water deposited within said pocket means for producing ice cubes therein and for selectively and simultaneously circulating said heated fluid exchange means through each of said conduit means for partially thawing the outer surface of said ice cubes and dislodging said ice cubes from said pockets for gravitational emptying prior to beginning the next ice forming cycle.

5. The system of claim 4 wherein said plurality of generally elongated conduit means is fixedly vertically oriented so as to automatically drop the frozen ice cubes into a receptacle once released from the pocket by the direct contact of the heat exchange means on the portion of the pocket disposed within the hollow interior of the conduit means.

6. The system of claim 4 wherein said plurality of conduit means is fixedly disposed in a horizontal position such that the longitudinal axes of each is vertically disposed for automatically gravitationally emptying the ice portions from the pockets once released by the direct application of the heat exchange means to the portion of said pocket disposed within the hollow interior of said conduit means.

7. The system of claim 4 further including means for normally positioning said plurality of conduit means such that the pockets on the conduit surface are horizontally disposed and means for rotating the plurality of conduit means for tilting said surface to at least one of a generally vertical and partially inverted position for enabling the gravitational emptying of the ice portions formed therein once released by the conduction of said fluid heat exchange means through the hollow interior of said conduit means.

8. The system of claim 4 wherein said ice-forming pocket means each includes a plurality of individual cup-shaped bodies, wherein said conduit means includes a plurality of apertures operably formed in said longitudinal surface and wherein said plurality of individual cup-shaped bodies are at least partially inserted into said aperture such that at least the lower portion thereof extends within the hollow interior of the conduit means for direct contact with any fluid being conducted therethrough.

9. The system of claim 4 wherein said plurality of ice-forming pocket means includes a plurality of indentation means extending along said surface of each of said conduit means and depressed sufficiently to produce an ice-formed pocket on the exterior surface while simultaneously depressing the opposite surface within the hollow interior of the conduit means for direct contact with any fluid being conducted therethrough.

* * * * *